US005611644A

United States Patent [19]

Lutz

[11] Patent Number: 5,611,644

[45] Date of Patent: Mar. 18, 1997

[54] BUCKLE FOR A DIVING MASK

[75] Inventor: James R. Lutz, Round Lake Beach, Ill.

[73] Assignee: Johnson Worldwide Associates, Sturtevant, Wis.

[21] Appl. No.: 552,499

[22] Filed: Nov. 9, 1995

[51] Int. Cl.[6] ..... B63C 11/02

[52] U.S. Cl. ..... 405/186; 2/428; 2/452; 24/323; 24/585; 128/207.14

[58] Field of Search ..... 405/186, 185; 24/323, 197, 442, 585; 128/201.18, 201.19, 200.26, 205.25, 202.14, 206.21, 206.29, 207.11, 207.14; 2/452, 447, 428, 909

[56] References Cited

U.S. PATENT DOCUMENTS

| | | | |
|---|---|---|---|
| D. 266,031 | 9/1982 | Sato . | |
| D. 318,476 | 7/1991 | Sato . | |
| 2,586,851 | 2/1952 | Monro et al. | 128/201.19 |
| 2,803,864 | 8/1957 | Bishaf | 24/323 |
| 3,671,976 | 6/1972 | Johnson et al. . | |
| 3,850,168 | 11/1974 | Ferguson et al. | 128/201.19 X |
| 4,077,068 | 3/1978 | Anderson . | |
| 4,352,353 | 10/1983 | Bolton et al. . | |
| 4,527,292 | 7/1985 | Kasama et al. | 24/323 X |
| 4,607,398 | 8/1986 | Faulconer | 2/452 |
| 4,856,120 | 8/1989 | Hart . | |
| 5,069,205 | 12/1991 | Urso | 128/207.11 X |
| 5,329,643 | 7/1994 | Sato . | |

FOREIGN PATENT DOCUMENTS

| | | | |
|---|---|---|---|
| 883278 | 3/1943 | France | 405/186 |
| 406056081A | 3/1994 | Japan | 405/186 |

*Primary Examiner*—Dennis L. Taylor
*Attorney, Agent, or Firm*—Foley & Lardner

[57] ABSTRACT

A strap retainer system is disclosed. The strap retainer system has particular utility with diving masks and includes a buckle pivotably mounted to a frame. The buckle cooperates with a swivel mechanism to permit selective adjustment of the strap length. Additionally, the swivel mechanism is rotatably mounted to the buckle to permit upward and downward pivoting of the strap along the divers head to promote comfort and fit.

16 Claims, 3 Drawing Sheets

BUCKLE FOR A DIVING MASK

FIELD OF THE INVENTION

The present invention relates generally to masks used for diving, such as scuba diving or skin diving, and particularly to an improved retainer buckle for attaching the head strap.

BACKGROUND OF THE INVENTION

A variety of underwater, diving masks have been used for many years in such activities as scuba diving or skin diving. The typical mask includes a rigid frame that supports a window or lens through which the diver may view his or her surroundings. A flexible skirt is also mounted to the frame and includes an edge designed to fit along the face of the diver. Typically, the skirt extends along the forehead, around the outside of the eyes and under the nose of the diver to prevent water from entering the space between the lens and the diver's eyes.

The mask is held against the diver's face in this sealing relationship by an elastomeric strap that extends about the back of the diver's head. Many modern masks have a silicone skirt that seals against the diver's face with minimal pressure. However, the mask strap is preferably adjustable to facilitate this sealing engagement with the diver's face without causing undue force against the diver's face or other discomfort. Most mask straps are adjustably mounted to the mask through a buckle assembly. Typically, the strap has a plurality of ridges that interact with a catch to allow the diver to adjust the length of the mask strap.

In certain conventional masks, the buckle assembly is affixed to the frame and includes a roller mounted on a pin. The mask strap extends through the buckle, wraps around the roller and doubles back on itself with the ridges extending outwardly. A spring-loaded catch is pivotably mounted within the frame to interact with a select ridge and hold the mask strap in place against the roller. If the length of the strap must be adjusted, the catch is simply pivoted against the force of the spring to release its engagement with the strap. The length of the strap is then adjusted to a desired length and the catch released. The spring pivots the catch back into engagement with the next selected ridge and holds the strap at that desired length.

This affixed buckle arrangement can be problematic when the diver wants to adjust the orientation of the mask strap about his or her head. Because the buckle does not pivot upwardly or downwardly with respect to the diver's head, the strap must generally be placed about the diver's head in one orientation. The diver may be able to move the strap upwardly or downwardly along the back of his or her head, but this is often less comfortable or less stable i.e. the strap is biased back towards a position in general alignment with the orientation of the buckle.

Attempts have been made to overcome this problem by constructing buckles that are pivotal. This allows the orientation of the mask strap to be adjusted with respect to the mask and the diver's head. For example, some divers may find it more comfortable to orient the mask strap at a slight upward angle and others may find it more comfortable to orient the mask strap at a somewhat downward angle rather than the conventional orientation that is substantially perpendicular to the lens of the mask.

Generally, the pivotal buckles include a plate pivotally mounted within a slot located within the frame of the mask. A roller is mounted at the opposite end of the plate to permit the strap to extend thereabout. A catch is pivotably mounted to the plate via a living hinge and interacts with ridges on the strap to maintain the strap in position. Thus, this type of buckle does not have the positive action of a spring loaded catch to pivot the catch into cooperation with the ridges on the strap. Additionally, the resiliency of the living hinge tends to decline over time with repeated usage.

It would be advantageous to design a pivotal buckle that utilized more dependable components and made possible the use of a spring loaded hinge.

SUMMARY OF THE INVENTION

The present invention features a diving mask assembly. According to a preferred embodiment of the invention, the assembly includes a mask having a frame and a lens mounted within the frame. A skirt is also connected to the frame and configured to fit against the face of the diver to maintain a pocket of air disposed between the lens and the diver's face. The mask also includes a strap retainer mounted to the frame. The strap retainer has a buckle plate pivotably mounted to the frame for pivotal motion about a first axis. A swivel mechanism is pivotably mounted between the frame and the buckle plate for pivotal motion about a second axis, the second axis being disposed in a generally transverse orientation with respect to the first axis.

Additionally, a mask strap is adjustably engaged with the swivel mechanism. The buckle plate cooperates with the swivel mechanism to permit adjustment of the mask strap when the buckle mechanism is appropriately pivoted about the first axis.

BRIEF DESCRIPTION OF THE DRAWINGS

The invention will hereafter be described with reference to the accompanying drawings, wherein like reference numerals denote like elements and.

DETAILED DESCRIPTION OF THE PREFERRED EMBODIMENT

The following description is of a preferred embodiment of the inventive system by which a diving mask is attached to a head strap. However, it should be understood that although the strap retainer is contemplated for use primarily with a diving mask and mask strap of the type used by divers in, for example, scuba or skin diving, the invention has potentially broader application. For instance, the strap retainer system could be used to adjustably secure a wide variety of straps, including tie-downs used to secure a variety of items.

Figure 1:
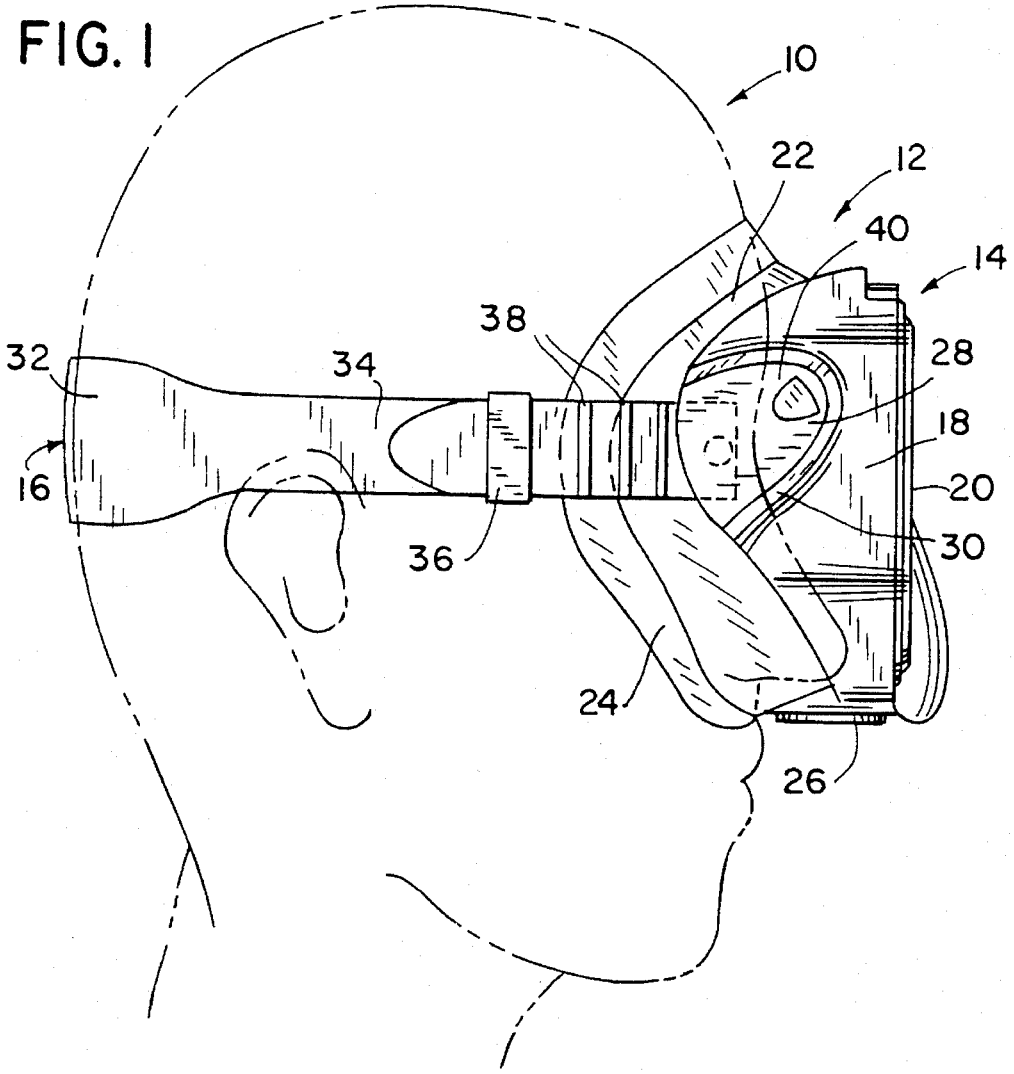
FIG. 1 is a side view of a diver wearing a diving mask assembly according to a preferred embodiment of the present invention.

Referring generally to FIG. 1, a diver 10 is illustrated wearing a diving mask assembly 12 constructed according to a preferred embodiment of the invention. Diving mask assembly 12 typically includes a mask 14 connected to a mask strap 16 that extends about the head of diver 10 to secure mask 14 over the eyes and nose. Often, diver 10 may wish to place mask strap 16 about his or her head in different orientations to promote comfort or a better fit of mask 14. For instance, diver 10 may wish to move mask strap 16 upwardly or downwardly along the back of his or her head. Thus, it is helpful when mask strap 16 is able to pivot upwardly and downwardly with respect to mask 14.

Mask 14 typically includes an outer frame 18 and a window or lens 20 sealingly mounted within outer frame 18. Lens 20 may be a single or double lens. A flexible skirt 22, often made of silicone, is also sealingly attached to outer frame 18 and is configured to contact the face of diver 10 along a peripheral sealing area 24. Sealing area 24 is held against the face of diver 10 by mask strap 16 to help prevent water from flowing into the air pocket formed between lens 20 and the face of diver 10. Optionally, mask 14 can include a purge valve 26 which permits diver 10 to clear any water that happens to enter the air pocket between the divers face and lens 20. Simply by exhaling through his or her nose, diver 10 can expel this internal water through the purge valve.

Mask 14 also includes at least one and preferably two strap retainers 28. Each strap retainer 28 is mounted to a side panel 30 of outer frame 18 as illustrated. Each strap retainer 28 is designed to receive and grip mask strap 16. However, the strap retainers 28 are also designed to permit diver 10 to selectively adjust the point at which mask strap 16 is gripped, thereby facilitating adjustment of the length of mask strap 16 to accommodate the head size of diver 10.

Mask strap 16 preferably includes a back portion 32 illustrated along the back of the divers head. A pair of side portions 34 extend forwardly from back portion 32 into cooperation with strap retainers 28. Generally, each side portion 34 loops through a corresponding strap retainer 28 and is doubled back on itself to be held in place by a clip 36. Side portions 34 can also include a plurality of ridges 38, as illustrated, to promote secure retention of mask strap 16 by each strap retainer 28.

Referring generally to FIGS. 2–5, a preferred embodiment of strap retainer 28 is illustrated. In this embodiment, a buckle plate 40 is mounted along its corresponding side panel 30. As illustrated, side panel 30 can be disposed within a recess 42 formed in outer frame 18. Buckle plate 40 is pivotably mounted to outer frame 18, preferably by a pair of buckle plate pins 44 (See FIG. 6) disposed along a pivot axis 46. Pivot axis 46 lies generally along side panel 30, as illustrated, and buckle plate pins 44 are received within a pair of apertures 48 formed in a perimeter wall 50 of recess 42.

Figure 4:
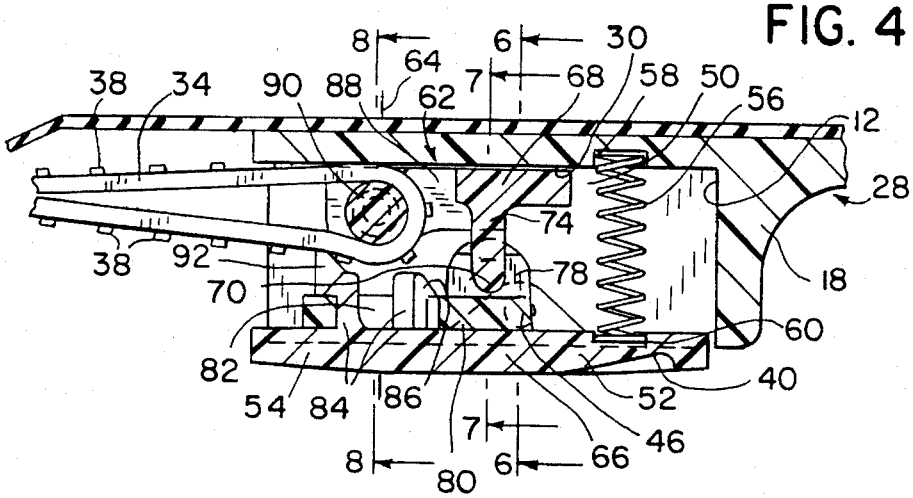
FIG. 4 is a cross sectional view taken generally along line 4—4 of FIG. 3.
Figure 5:
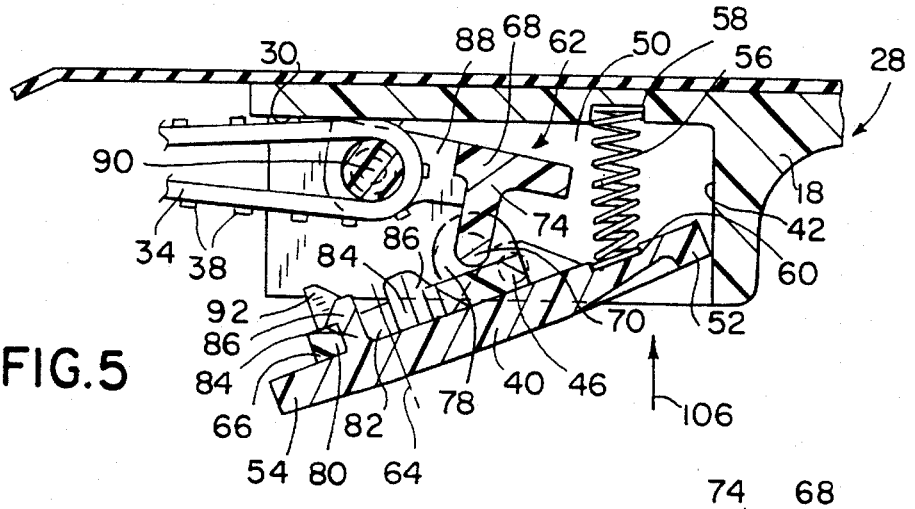
FIG. 5 is a cross sectional view similar to the cross sectional view of FIG. 4, but showing the strap retainer system in an open position.
Figure 6:
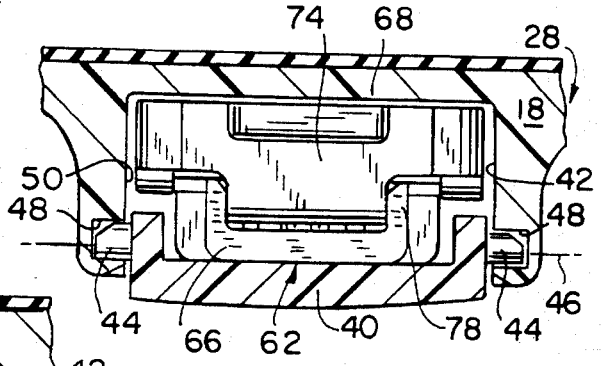
FIG. 6 is a cross sectional view taken generally along line 6—6 of FIG. 4.

As best illustrated in FIGS. 4 and 5, buckle plate 40 includes a first extended portion 52 and a second extended portion 54. Extended portions 52 and 54 are disposed on opposite sides of pivot axis 46. As a result, when first extended portion 52 is moved in a general inwardly direction, second extended portion 54 is pivoted in a generally outward direction with respect to side panel 30.

A resilient member 56 interacts with outer frame 18 and first extended portion 52 to bias buckle plate 40 in a predetermined direction about pivot axis 46. In the illustrated embodiment, resilient member 56 is a coil spring disposed between side panel 30 and first extended portion 52. The coil spring is held in place within a pair of spring recesses 58 and 60 disposed in side panel 30 and first extended portion 52, respectively.

A swivel mechanism 62 is disposed between buckle plate 40 and outer frame 18, and preferably between buckle plate 40 and side panel 30 for pivotable motion about a second pivot axis 64. Second pivot axis 64 is disposed generally transversely to side panel 30 and first axis 46, although the axes preferably do not intersect each other. Swivel mechanism 62 is designed to receive and grip a side portion 34 of mask strap 16. Frame 18, buckle plate 40 and swivel mechanism 62 are disposed in cooperative engagement to selectively permit adjustment of the length of mask strap 16. After adjustment, frame 18, buckle plate 40 and swivel mechanism 62 cooperate to hold or grip the appropriate side portion 34 at a desired point, thereby maintaining the desired length of mask strap 16. Although swivel mechanism 62 could potentially be pivotably mounted to frame 18 or a combination of frame 18 and buckle plate 40, it is preferably pivotably mounted solely to buckle plate 40 as illustrated.

Figure 7:
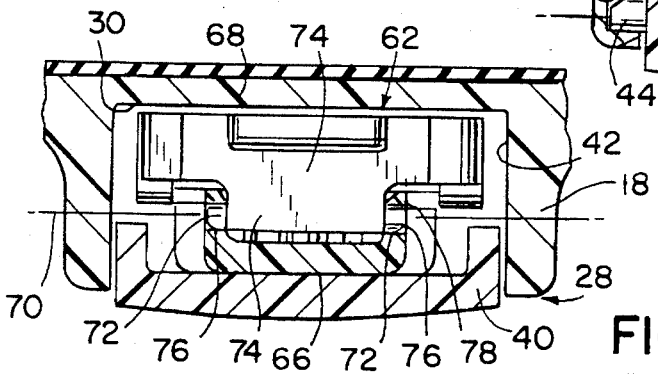
FIG. 7 is a cross sectional view taken generally along line 7—7 of FIG. 4.

Specifically, a preferred embodiment of swivel mechanism 62 includes an outer swivel component 66 and an inner swivel component 68. Outer swivel component 66 and inner swivel component 68 are pivotably connected together along a third pivot axis 70. As illustrated best in FIG. 7, inner swivel component 68 includes a pair of pins 72 that extend outwardly from a base portion 74 of inner swivel component 68. Outer swivel component 66 includes a pair of corresponding apertures 76 located in a base portion 78 thereof.

Outer swivel component 66 also includes a platform 80 having a pivot aperture 82 therethrough. Platform 80 lies along the inside surface of buckle plate 40 and is held proximate buckle plate 40 by at least one and preferably three extensions 84 having flanged ends 86. Extensions 84 can be pressed through pivot aperture 82 sufficiently far so flanged ends 86 hook platform 80 and prevent it from moving away from buckle plate 40. However, extensions 84 and flanged ends 86 do not prevent the pivoting of outer swivel component 66 along the inside surface of buckle plate 40. This arrangement permits the pivoting of the entire swivel mechanism 62 with respect to frame 18 so diver 10 can adjust the orientation of mask strap 16 along the sides and back of his or her head. In other words, mask strap 16 can be moved upwardly or downwardly along the head of the diver, and swivel mechanism 62 pivots about second pivot axis 64 to prevent undue bending or kinking of mask strap 16.

Inner swivel component 68, on the other hand, includes a pair of legs 88 that extend from base portion 74 towards second pivot axis 64. Legs 88 are spaced to receive a rotatable pin 90. Rotatable pin 90 is disposed a sufficient distance from base portion 74 to permit one of the side portions 34 of mask strap 16 to be wrapped thereabout and doubled back on itself as illustrated best in FIGS. 4 and 5. Thus, side portion 34 can be moved about rotatable pin 90 until mask strap 16 is at a desired length. The side portion 34 can then be squeezed between outer swivel component 66 and inner swivel components 68 to secure the side portion 34 in place. Preferably, a protrusion 92 is disposed on platform 80 to interact with rotatable pin 90 and squeeze the side portion 34 therebetween.

Figure 8:
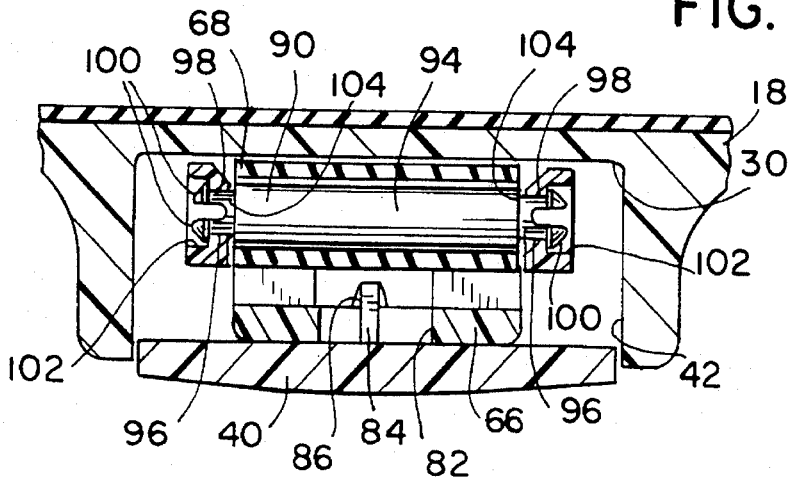
FIG. 8 is a cross sectional view taken generally along line 8—8 of FIG. 4.

Rotatable pin 90 can have a variety of shapes and configurations, but a preferred embodiment is best illustrated in FIG. 8. In this embodiment, rotatable pin 90 is a unitary plastic pin having a central roller section 94. A pair of narrower neck regions 96 extend outwardly from central roller section 94. Neck regions 96 can be divided into a plurality of axially extending segments 98 that terminate in flanged portions 100. Central roller section 84 and segments 98 are sufficiently flexible to permit rotatable pin 90 to be snapped into appropriately configured receptacles 102 formed in legs 88 of inner swivel component 68. Receptacles 102 include an orifice 104 sized to rotatably support neck regions 96, but smaller than the diameter across flanged portions 100 and central roller section 94. Thus, rotatable pin 90 can be snapped into place and securely held as illustrated in FIG. 8.

The actual operation of strap retainer 28 is best described by referring once again to FIGS. 4 and 5. Diving mask assembly 12 could be constructed with a single strap retainer 28, but it preferably includes a strap retainer 28 on each side of outer frame 18. Thus, the length of mask strap 16 can be adjusted on one or potentially both sides of mask 14.

Initially, the desired side portion 34 is threaded through swivel mechanism 62 around rotatable pin 90. At this point diver 10 adjusts the length of mask strap 16 for maximum comfort and utility. Diver 10 initially depresses first extended portion 52 of buckle plate 40 in the direction of arrow 106 shown in FIG. 5. This action compresses resilient member 56 and pivots swivel mechanism 62 away from side panel 30. It should be rated that swivel mechanism 62 is mounted on the opposite side of first pivot axis 46 from resilient member 56.

Pressing first extended portion 52 permits rotatable pin 90, mounted on inner swivel component 68, to pivot away from protrusion 92 of outer swivel component 66. At this point, rotatable pin 90 is able to freely rotate and side portion 34 can be moved through swivel mechanism 62 until mask strap 16 is at a desired length. First extended portion 52 of buckle plate 40 is then released, and resilient member 56 pivots buckle plate 40 about first pivot axis 46 until second extended portion 54 of buckle plate 40 forces inner swivel component 68 against frame 18, specifically side panel 30.

The force exerted by resilient member 56 is also sufficient to pivot outer swivel component 66 with respect to inner swivel component 68 until protrusion 92 cooperates with rotatable pin 90 to squeeze side portion 34 therebetween. The continued force exerted by resilient member 56 also securely holds side portion 34 between protrusion 92 and rotatable pin 90.

Figure 2:
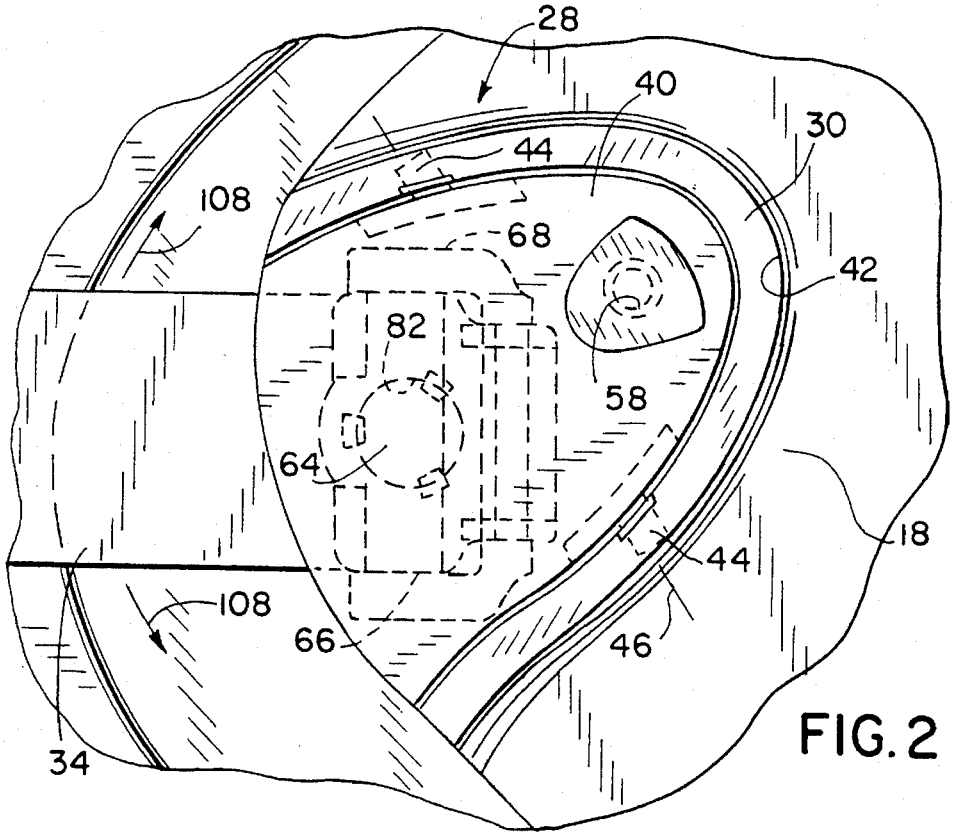
FIG. 2 is a side view of the retainer strap system illustrated in FIG. 1.
Figure 3:
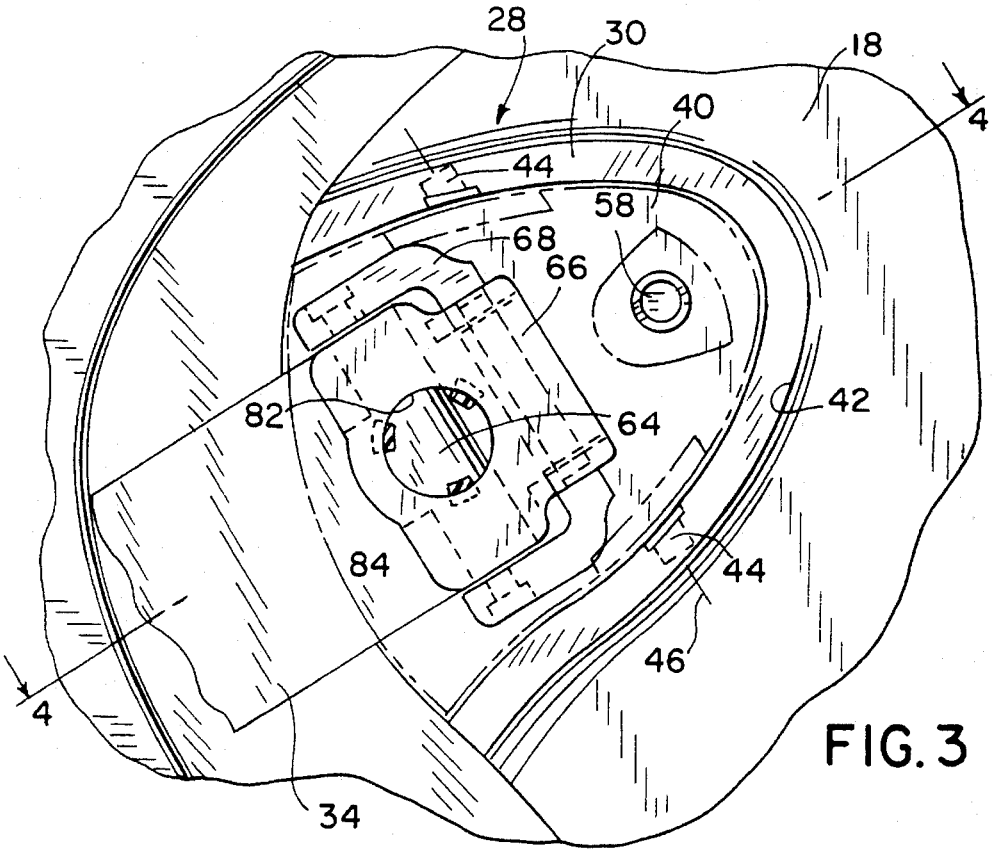
FIG. 3 is a partially broken away view of the retainer strap system of FIG. 2.

However, because both inner swivel component 68 and outer swivel component 66 are capable of simultaneous pivotable motion about second pivot axis 64, the orientation of side portion 34 may be changed without affecting the length of mask strap 16. As illustrated in FIG. 2 by arrows 108, the orientation of side portions 34 and mask strap 16 can be adjusted upwardly or downwardly by pivoting swivel mechanism 62 about second pivot axis 64 without undesirable kinking or bending of side strap 34.

It will be understood that the foregoing description is of a preferred exemplary embodiment of this invention and that the invention is not limited to the specific form shown. For example, a variety of diving mask designs may be used in combination with the strap container, the swivel mechanism can potentially be rotatably mounted to the frame, the side panel may have a variety of contours, the swivel mechanism have a variety of configurations and the resilient member can take a variety of forms, including plastic and metal compression springs, elastomeric bands or living hinges. These and other modifications can be made in the design and arrangement of the elements without departing from the scope of the invention as expressed in the appended claims.

What is claimed is:

1. A diving mask assembly comprising:

a mask including:

a frame;

a lens mounted in the frame;

a skirt mounted to the frame; and a strap retainer mounted to the frame, the strap retainer having a buckle plate pivotably mounted to the frame for pivotable motion about a first axis and a swivel mechanism pivotably mounted between the frame and the buckle plate for pivotable motion about a second axis, the second axis being generally transverse to the first axis; and a mask strap adjustably engaged with the swivel mechanism, wherein the buckle plate cooperates with the swivel mechanism and is selectively pivoted to permit adjustment of the mask strap.

2. The diving mask assembly as recited in claim 1, further comprising a spring member disposed between the frame and the buckle plate to bias the buckle plate in a predetermined rotational direction.

3. The diving mask assembly as recited in claim 2, wherein the spring member includes a coil spring.

4. The diving mask assembly as recited in claim 3, wherein the swivel mechanism is pivotably connected solely to the buckle plate for pivotable motion about its second axis.

5. The diving mask assembly as recited in claim 4, wherein the swivel mechanism includes an outer component, an inner component, and a rotatable pin, the outer component being pivotably connected to the buckle plate for pivotable motion about the second axis, the inner component being pivotably connected to the outer component for pivotable motion about a third axis, and the rotatable pin being rotatably mounted to the inner component.

6. The diving mask assembly as recited in claim 5, wherein the rotatable pin includes a pair of flanged ends and the inner component includes a pair of cavities configured to receive and rotatably hold the pair of flanged ends.

7. The diving mask assembly as recited in claim 5, wherein the mask strap extends about the rotatable pin and is selectively held stationary against the roller by the outer component.

8. The diving mask assembly as recited in claim 7, wherein the mask strap includes a plurality of ridges, and the outer component includes a projection disposed to interact with a selected ridge of the plurality of ridges when the spring member is released.

9. The diving mask assembly as recited in claim 5, wherein the outer component includes a circular opening and the buckle plate includes at least one flanged extension disposed through the circular opening to rotatably secure the outer component to the buckle plate.

10. The diving mask assembly as recited in claim 9, wherein the spring and the at least one flanged extension are located on opposite sides of the first axis.

11. A strap retainer system configured to adjustably control the length of the strap while permitting changes in the orientation of the strap, comprising:

a frame having a side panel;

a buckle plate pivotably mounted to the frame for pivotable motion about a first axis, the first axis being spaced from the side panel;

a resilient member acting between the buckle plate and the frame to bias the buckle plate in a predetermined rotational direction about the first axis; and a swivel mechanism rotatably mounted between the frame and the buckle plate for rotatable movement about a second axis, the second axis being oriented generally transverse to the side panel, the swivel mechanism being configured to receive the strap, wherein the resilient member biases the buckle plate into cooperation with the swivel mechanism to force the swivel mechanism to hold the strap at selected points.

12. The strap retainer system as recited in claim 11, wherein the resilient member is a coil spring disposed between the side panel and a first extension of the buckle plate.

13. The strap retainer system as recited in claim 12, wherein the buckle plate includes a second extension on an opposite side of the first axis from the first extension, the second extension being disposed to contact the swivel mechanism.

14. The strap retainer system as recited in claim 13, wherein the swivel mechanism includes an inner swivel component having a rotatable pin about which the strap can be wrapped and an outer swivel component having a projection, the outer swivel component being pivotably connected to the inner swivel component along a third axis to permit the projection to be selectively pivoted into cooperation with the rotatable pin to hold the strap therebetween.

15. The strap retainer system as recited in claim 14, wherein the outer swivel component is rotatably mounted to the buckle plate.

16. The strap retainer system as recited in claim 15, wherein the outer swivel component includes an opening and the buckle plate includes a flanged extension, the opening receiving the flanged extension to rotatably secure the swivel mechanism to the buckle plate.

* * * * *